US006038846A

United States Patent [19]

Mack

[11] Patent Number: 6,038,846

[45] Date of Patent: Mar. 21, 2000

[54] ROVING FRAME WITH A DEVICE ENABLING FULL ROVING BOBBINS TO BE REPLACED AUTOMATICALLY BY EMPTY ROVING SLEEVES

[75] Inventor: Karl-Heinz Mack, Weilheim, Germany

[73] Assignee: Zinser Textilmaschinen GmbH, Ebersbach/Fils, Germany

[21] Appl. No.: 09/068,914

[22] PCT Filed: Oct. 14, 1997

[86] PCT No.: PCT/DE97/02370

§ 371 Date: May 18, 1998

§ 102(e) Date: May 18, 1998

[87] PCT Pub. No.: WO98/17849

PCT Pub. Date: Apr. 30, 1998

[30] Foreign Application Priority Data

Oct. 22, 1996 [DE] Germany ..... 196 43 655

[51] Int. Cl.[7] ..... D01H 9/10

[52] U.S. Cl. ..... 57/281; 267/274

[58] Field of Search ..... 57/281, 267, 274

[56] References Cited

U.S. PATENT DOCUMENTS

| | | | |
|---|---|---|---|
| 3,935,699 | 2/1976 | Iida et al. | 57/267 |
| 5,671,596 | 9/1997 | Mack et al. | 57/267 |
| 5,697,205 | 12/1997 | Mack | 57/281 |
| 5,797,255 | 8/1998 | Saito et al. | 57/281 |

FOREIGN PATENT DOCUMENTS

| | | | |
|---|---|---|---|
| 0 310 568 B1 | 7/1988 | European Pat. Off. . | |
| 0 311 862 A1 | 4/1989 | European Pat. Off. . | |
| 28 38 398 | 3/1980 | Germany . | |
| 39 36 518 A1 | 5/1991 | Germany . | |
| 44 36 277 A1 | 4/1995 | Germany . | |
| 195 02 586 A1 | 8/1996 | Germany . | |
| 51-34008 | 9/1976 | Japan | 57/267 |
| 04153330 | 5/1992 | Japan . | |
| 4-352824 | 12/1992 | Japan | 57/267 |

*Primary Examiner*—William Stryjewski
*Attorney, Agent, or Firm*—Herbert Dubno

[57] ABSTRACT

The invention concerns a roving machine with a device for the automatic replacement of full roving bobbins journalled on a bobbin rail 4, with empty roving sleeves 13, which has at least one guide rail 5 for feeding a suspension carriage train 10 into and out of the region having front and rear flyer rows of a flyer rail 3 and a replacement region, the guide rail being transverse to the longitudinal direction of the roving machine and the suspension carriage trains having hangers in which the full bobbins 12 or the empty roving sleeves can be suspended for their automatic replacement in working positions, whereby the suspension carriage trains are each displaceable between the front and rear flyer rows in the guide rails and whereby the bobbin rail 4 is laterally movable relative to the suspension carriage train 10.

14 Claims, 6 Drawing Sheets

ROVING FRAME WITH A DEVICE ENABLING FULL ROVING BOBBINS TO BE REPLACED AUTOMATICALLY BY EMPTY ROVING SLEEVES

CROSS REFERENCE TO RELATED APPLICATIONS

This application is a national stage of PCT/DE97/02370 filed Oct. 14, 1997 and based, in turn, on German national application 19643655.9 filed Oct. 22, 1996 under the International Convention.

FIELD OF THE INVENTION

The invention relates to a roving machine with a device for the automatic replacement of full roving bobbins by empty roving sleeves and of the type in which bobbin carriers are arranged in two longitudinal rows on a bobbin rail and the device has a plurality of guide rails each of which is juxtaposable with one bobbin carrier and each of the two longitudinal rows and which extend substantially transversely to the longitudinal dimension of the machine.

BACKGROUND OF THE INVENTION

As state of the art, a roving frame with two flyer rows is already known (DE 195 02 586 A1) which is so conceived that the suspension carriage trains are movable transverse to the longitudinal direction of the roving frame in only every two flyers, and indeed into one flyer of the rear flyer row and a flyer of the front flyer row. Guide rails can be provided for this purpose which are either fixed or telescopable or have swingable segments.

A further state of the art is comprised of a device (DE 42 29 296 A1) by which a suspension carriage train on a guide rail running through the flyers is movable into the change position. For this purpose, below the heads of the flyers and/or under the flyer rail of the roving machine, specially formed guide members are arranged which form a guide rail from which a suspension carriage train is suspended along the longitudinal axis of the roving machine in transverse positions of the flyers.

It has been proposed furthermore in a roving machine to locate a guide rail along at least one of the rows of flyers in which a suspension carriage train can be fed into the machine. By lifting movements and lowering movements of the bobbin rail, the bobbins can be transferred from the bobbin rail onto the hangers of the suspension carriage train and sleeves from the hangers can be transferred to the bobbin rail. The bobbin rail and/or the guide rails can be shiftable back and forth. Fixedly arranged guide rails can be located on the underside of the flyer rail; movable guide rails are arranged in regions beneath the flyers.

OBJECT OF THE INVENTION

It is the object of the present invention to provide a simple device whereby the suspension carriage trains can be fed into and out of the guide rails.

SUMMARY OF THE INVENTION

These objects are achieved, in accordance with the invention in that the guide rails are arranged laterally of vertical planes containing the two bobbin carriers which are juxtaposed with the respective guide rail and the bobbin rail, laterally shiftable so that the vertical planes containing the bobbin carriers coincide with the vertical planes of the respective guide rail. Alternatively or in addition, the guide rail can be movable in a horizontal plane below the lower edges of the flyers. As a consequence, the advantage of a function oriented device can be obtained with automatic replacement of the full roving bobbins by empty roving sleeves, whereby the arrangement of the guide rails insures that the suspension carriage trains can be fed into and out of the flyer regions transverse to the longitudinal direction of a roving frame over the shortest paths and thus rapidly. Advantageously, the guide rails are arranged in a region above the bobbin rail between an underside of a respective flyer and a flyer rotation space. The guide rails can be arranged midway between vertical planes containing the two respective bobbin carriers.

The suspension carriage trains can be laterally flexible and the guide rails can be angled. Alternatively the suspension carriage trains can be displaceable in linear guide rails and can be formed as rigid bars. The guide rails can be configured as support rail segments above the bobbin rail and they can be swingable about horizontal axes above the bobbin rail. The suspension carriage trains can be shiftable collectively automatically by means of a push/pull device which can be pneumatic, hydraulic or electric and which can include a scissor-linkage system or a threaded spindle and spindle nut.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
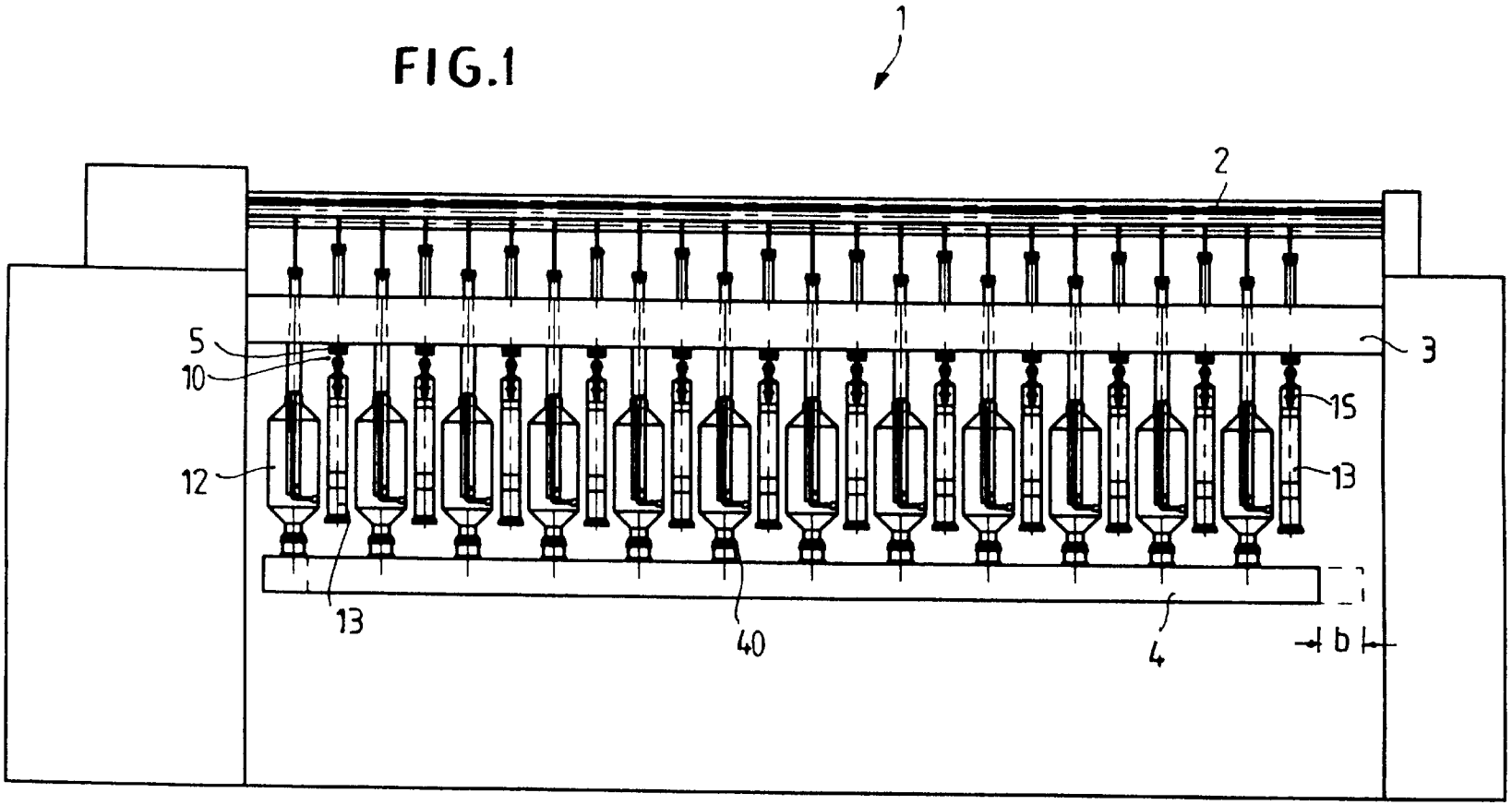
FIG. 1 is schematic front elevational view of a roving machine with a suspension carriage train which has previously been fed into it.
Figure 1A:
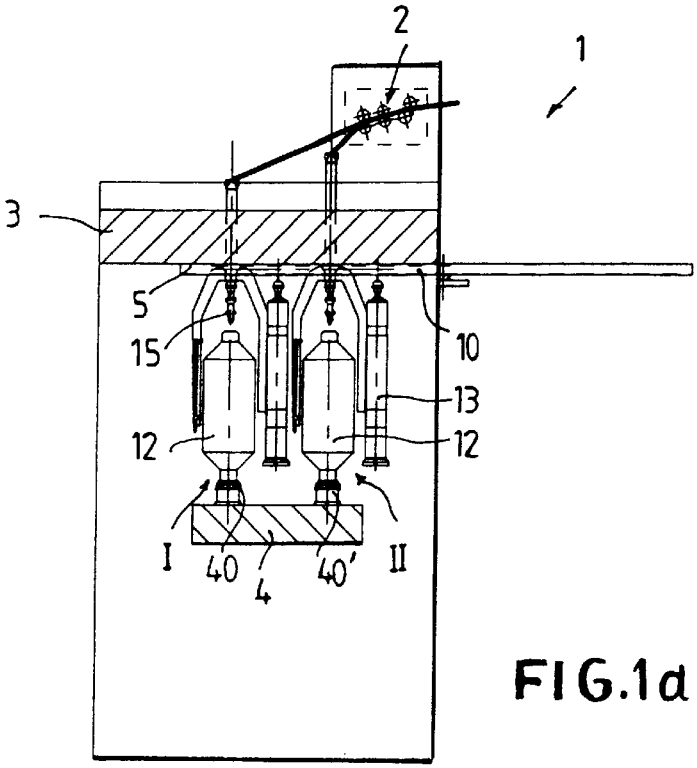
FIGS. 1*a* and 1*b* are respective sections through a ring spinning machine into which the suspension carriage train has been fed in two different segments of the process.
Figure 1B:
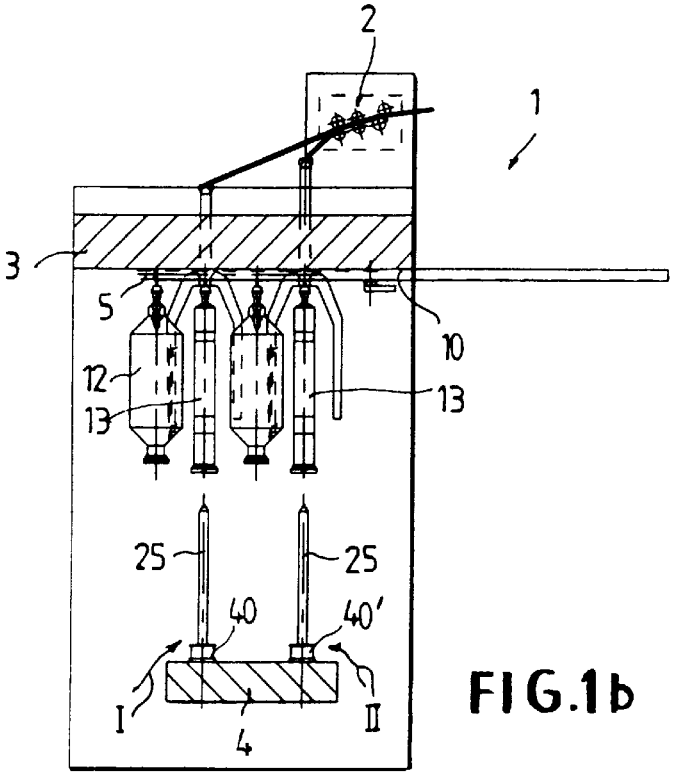
Figure 1C:
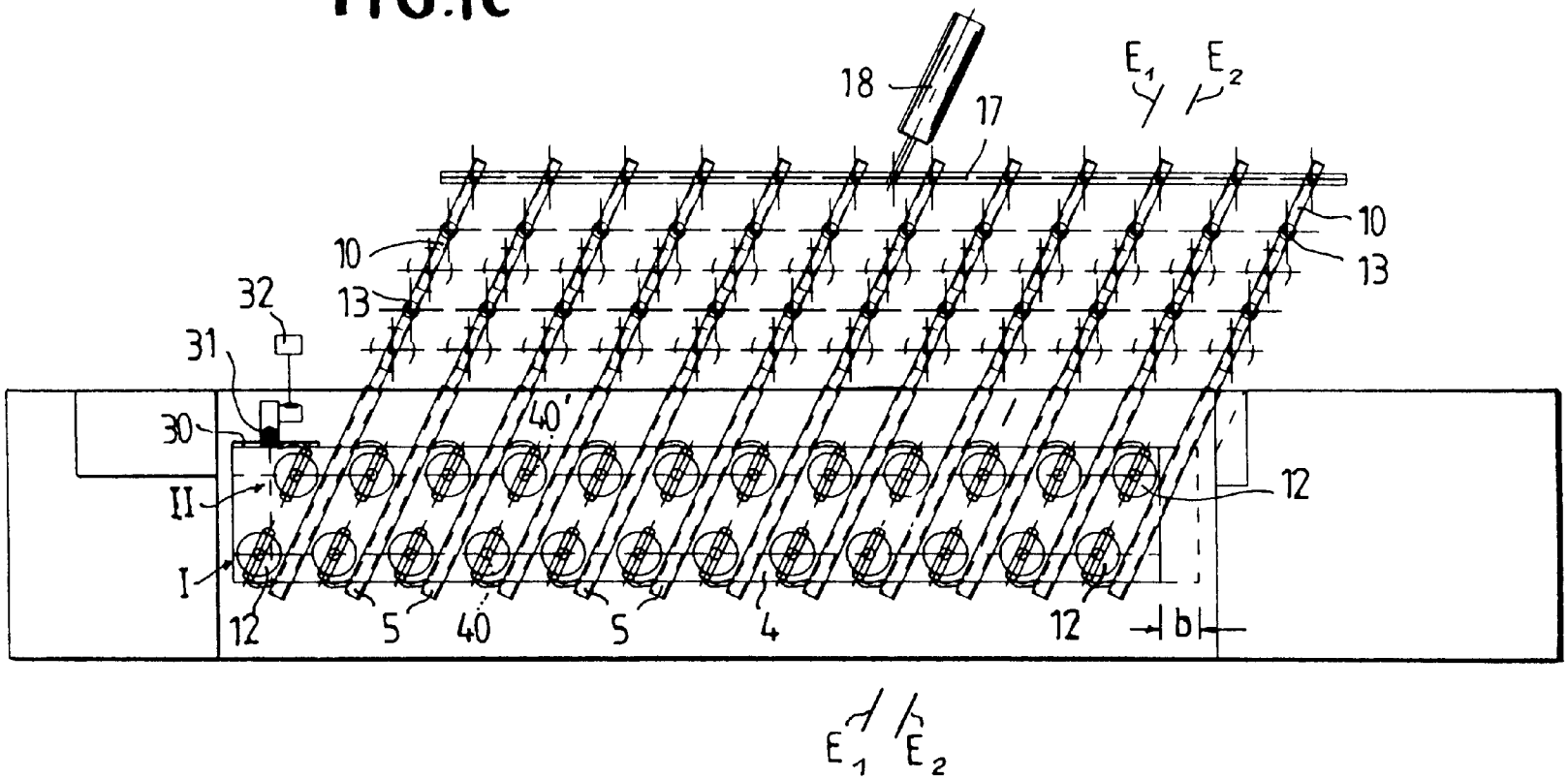
FIG. 1*c* is a plan view of a ring spinning machine in the embodiment of FIG. 1.

FIG. 1 shows a roving machine 1 with a drafting frame 2, a flyer rail 3 which is fixed and a bobbin rail 4 which can be raised and lowered as required for its proper function by means of a controllable drive not shown, the bobbin rail 4 being provided with bobbin carriers 40 and 40'. As shown in FIGS. 1*a* through 1*c*, on the bobbin rail 4 there are provided a front longitudinal row or bobbin row I as well as a rear longitudinal row or bobbin row II whereby the front bobbin row I contains the bobbin carriers 40 and the rear bobbin row II contains the bobbin carriers 40'. The bobbin carriers carry roving bobbins 12 which, in accordance with the working pattern, are replaced by empty bobbin sleeves 13. For this purpose use is made of suspension carriage trains 10 which are fed into and out of guide rails 5 substantially transverse to the longitudinal direction of the roving machine and thus into the regions of the front and rear bobbin rows I and II or out of these regions.

The guide rails 5 are, according to FIG. 1*c*, arranged laterally of vertical planes $E_1$—$E_1$ which contain the two bobbin carriers 40 and 40'. They are, especially as shown in FIGS. 1*a* and 1*b*, fixedly arranged on the underside of the flyer rail 3.

According to FIGS. 1 and 1*a*, the suspension carriage trains 10 are fed into the guide rails 5 in the regions of the front and rear bobbin rows I and II. In the process step according to FIG. 1*a*, the bobbin rail 4 with the full bobbins 12 is lowered by a predetermined amount, whereby the suspension carriage trains 10 are fed into the guide rails sufficiently that their empty hangers 15 lie in the vertical planes of the bobbins 12 of the two bobbin rows I and II.

Upon displacement of the bobbin rail 4 by an indicated distance b, the empty hangers 15 are located directly above the full bobbins 12. The bobbin rail 4 is thus laterally so shiftable that the vertical planes $E_1$—$E_1$ containing the bobbin carriers 40 and 40' coincide with the respective vertical planes $E_2$—$E_2$ in which the guide rails 5 run.

Then the bobbin rail 4 is lifted sufficiently that the full bobbins 12 are hung in the empty hangers 15 of the suspension carriage trains 10.

Then the bobbin rail 4 is again lowered and the suspension carriage trains 10 moved forwardly sufficiently that the hangers 15 fitted with empty sleeves 13 lie above the (empty) bobbin spindles 25 (FIG. 1*b*). Thereafter the bobbin rail 4 is again lifted and the empty bobbin sleeves 13 removed from the suspension carriage train 10 which is necessary for the next stage. Thereafter, the suspension carriage train 10 is withdrawn from the flyer and bobbin region, the bobbin rail 4 is moved back into its normal working position whereupon the roving machine can be restored to operation.

From FIG. 1*c* it is apparent that the straight guide rails 5 run in the region of the bobbin rows I and II whereby the guide rails 5 are movable and the suspension carriage trains 10 formed as rigid bars are connected with a common connecting rod 17 as well as with a drive element connected therewith. Thus the suspension carriage trains allow themselves to be inserted into and withdrawn from the guide rails in common, i.e. moved into the region of the bobbin rows I and II or into a replacement region lying rear of the roving machine and in which until the next replacement operation the full bobbins are removed by hand or by an automatic device from the suspension hangers and the latter are again equipped with empty sleeves.

From FIG. 1*c* it is also recognizable that the bobbin rail 4, for example, via a rack 30 and a pinion 31 and a drive 32, can be laterally shiftable by the amount b so as to move the bobbin spindles 25 into the vertical planes of the hangers 15 of the respective suspension carriage trains 10 or out of the latter.

Figure 2:
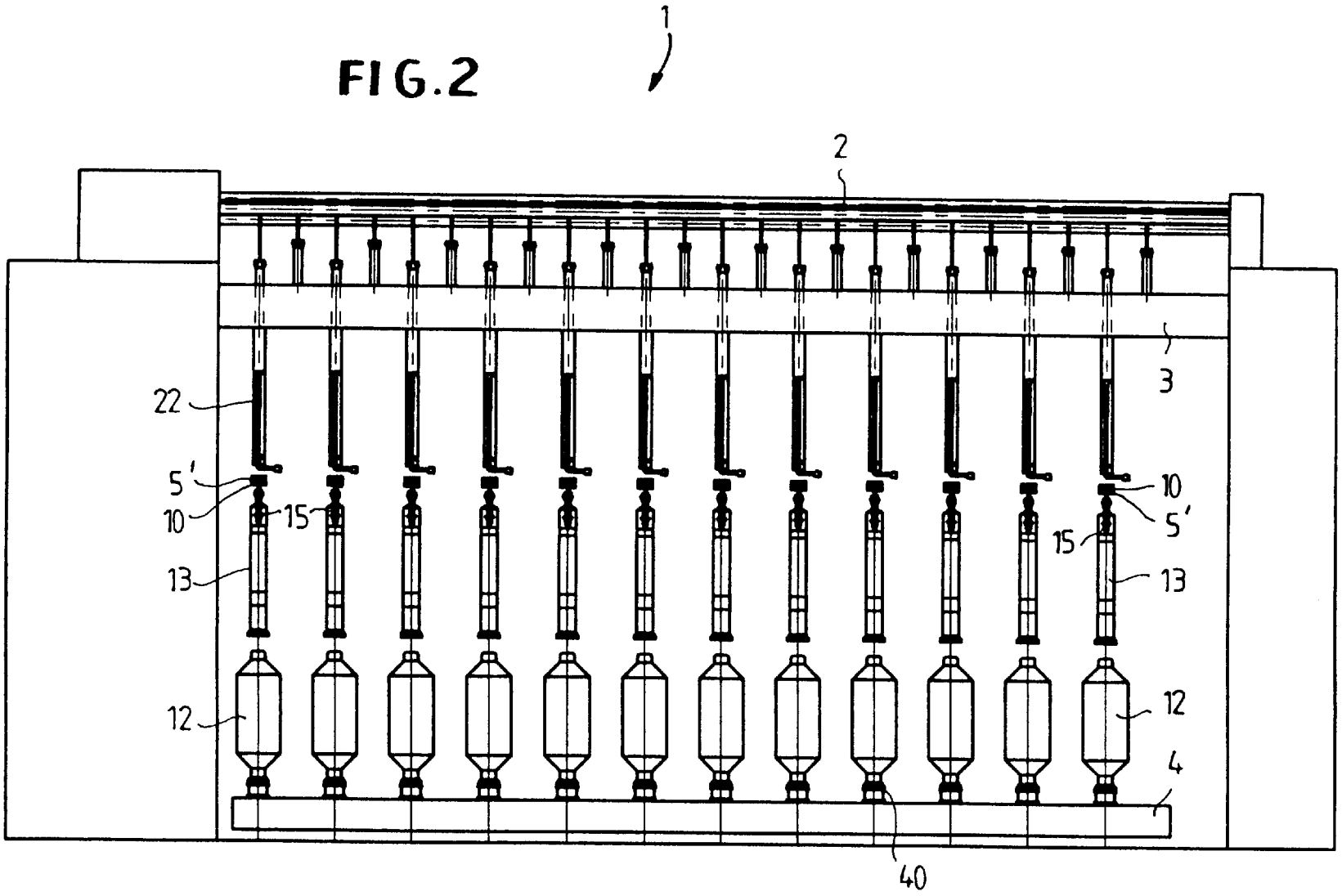
FIG. 2 is a schematic front elevational view of a ring spinning machine in another embodiment with illustration of the front flyer row and the suspension holders which have been fed into it.

In the embodiment of FIG. 2, the bobbin rail is not laterally shiftable. The guide rails 5' are, for the replacement operation, movable in a plane below the lower edges of the flyers 22. They are located upon the replacement process, in the vertical planes $E_1$—$E_1$, which contain the two bobbin carriers 40 and 40' which are respectively juxtaposed with the guide rail 5'. The latter are formed as rigid rails and from the suspension carriage trains 10.

Figure 2A:
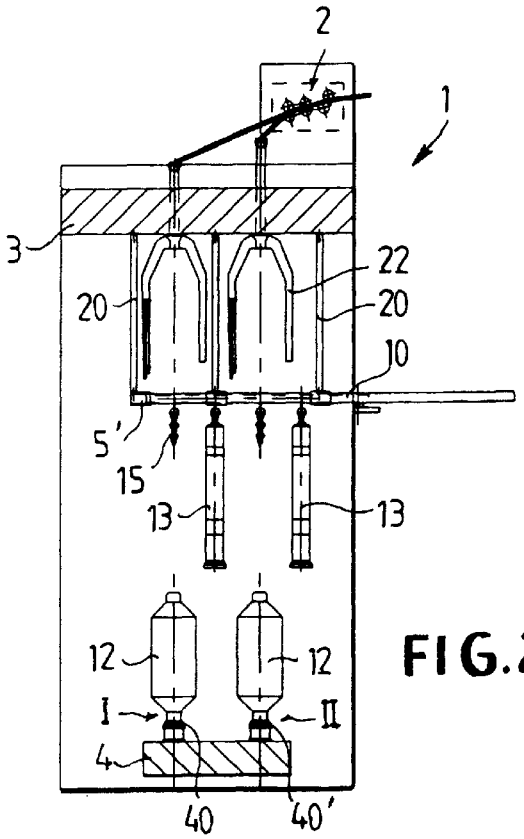
FIGS. 2*a* and 2*b* are respective sections through a roving frame analogous to FIG. 2 in two different process modes and in two different embodiments.

The suspension carriage trains can be guided, as shown in FIG. 2*a*, by support members 20 arranged on the underside of the flyer rail. In the variation of the embodiment of FIG. 2*b* the guide rail 5" is restricted to the region below the machine frame. The "suspension carriage trains" are thus so rigid that they are self supporting and can be guided into the regions of the flyers and bobbins. In the position shown in FIG. 2*a*, the suspension carriage trains 10 are fed so far into the regions of the bobbin rows I and II that each empty hanger 15 is disposed above a respective full bobbin 12 on the bobbin rail 4. Then this bobbin rail 4 is raised and the full roving bobbins 12 can be transferred via the hangers 15 onto the suspension carriage trains 10.

Then the suspension carriage trains 10 are displaced forwardly sufficiently that the respective empty roving bobbins 12 is disposed above the respective spindles of the bobbin rail 4. This bobbin rail 4 travels again, as has been described above and receives from the suspension carriage train 10 the empty roving sleeves 13.

Figure 2B:
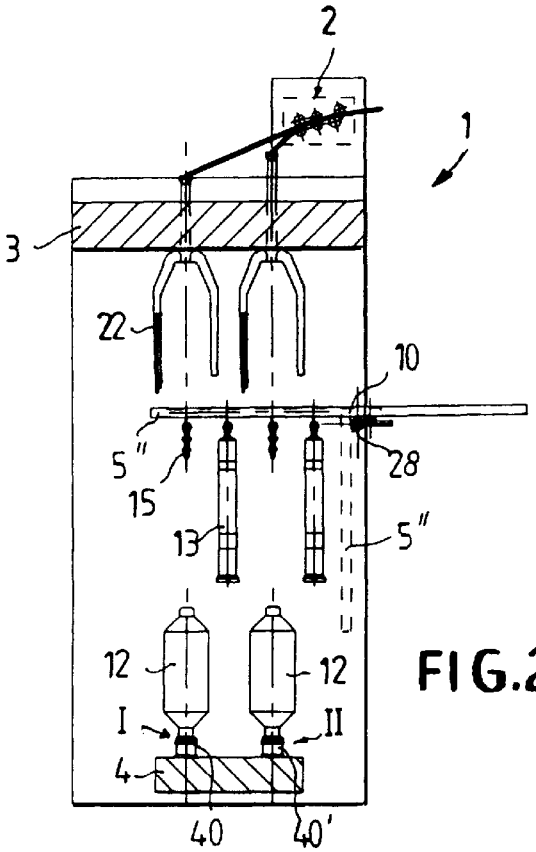

In the embodiment of FIG. 2*b*, the suspension carriage trains 10 are displaceable in the guide rails 5" which are swingable about a horizontal axis 28 from the working positions into the broken line rest positions. The process sequence is identical with that of FIG. 2*a*.

Figure 3:
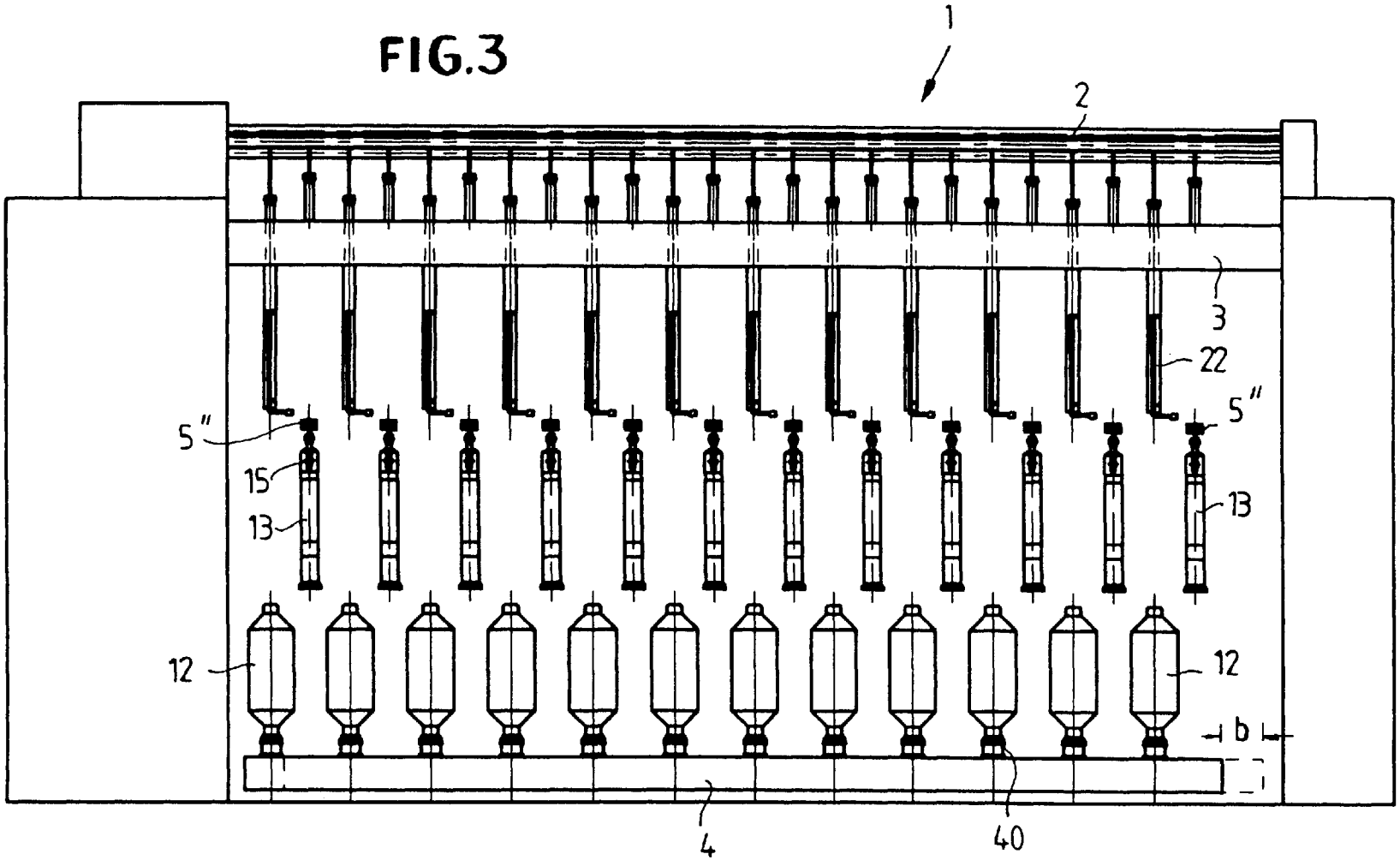
FIG. 3 is a schematic front elevational view of a roving frame in a further embodiment with a front flyer row and suspension holders fed into it.

The embodiment of FIG. 3 represents a combination of the embodiments of FIGS. 1 and 2: the suspension carriage trains move along respective spur tracks which lie below the flyers 22 but above the bobbin spindles 25 and are also offset laterally to the flyers and bobbins. The bobbin rail 4 is here again shiftable by the distance b. The sequence of the replacement process takes place as has been described based upon the sequence described in the embodiments of FIGS. 1 through 1*b* and 2 and 2*b*.

As is especially indicated from FIG. 1*c*, the suspension carriage trains can also be moved in rectilinear guide rails 5 and thereby formed as rigid bars. In many cases there is insufficient space for an inclined path of these guide rails 5 through the machine frame. The guide rails 5 must then be angled and the suspension carriage trains 10 should then, as is known per se, should comprise "flexibly coupled carriages" forming the "trains" not described in greater detail herein.

As can be recognized from FIG. 1*b*, the bobbin rail 4 has bobbin spindles 25 which rotate the sleeves 13 or the bobbin 12 rapidly. These fixtures for the bobbins and sleeves can also be provided on flyer spindles arranged on the flyers and which extend from above into the sleeves or bobbins. The replacement sequence does not change in this case.

I claim:

1. A roving machine with a device for automatic replacement of full roving bobbins by empty roving sleeves mounted on bobbin carriers which arranged in two longitudinal rows on a bobbin rail, said device comprising:

a plurality of guide rails each juxtaposable respectively with one bobbin carrier of each of the two longitudinal rows and extending substantially transversely to a longitudinal dimension of the machine and to said longitudinal rows;

hangers guided in said rails for suspending the roving bobbins and empty bobbin sleeves and forming suspension carriage trains displaceable into regions above the bobbin rail and into a replacement region, the guide rails being arranged laterally of vertical planes containing the two bobbin carriers which are juxtaposed with the respective guide rail; and means for laterally shifting the bobbin rail so that the vertical planes containing the bobbin carriers coincide with respective vertical planes of the respective guide rails.

2. The roving machine defined in claim 1 wherein the guide rails are arranged in a region above the bobbin rail between an underside of a respective flyer and a flyer rotation space.

3. The roving machine defined in claim 2 wherein the guide rails are arranged midway between vertical planes containing the two bobbin carriers.

4. The roving machine defined in claim 3 wherein the guide rails are configured as support rail segments above the bobbin rail.

5. The roving machine defined in claim 1 wherein the suspension carriage trains are laterally flexible and the guide rails are angled.

6. The roving machine defined in claim 1 wherein the suspension carriage trains are displaceable in the guide rails which are linear and are formed as rigid bars.

7. The roving machine defined in claim 1, wherein the suspension carriage trains are shiftable collectively automatically by means of a push/pull device.

8. The roving machine defined in claim 7 wherein the push/pull device is a directly connected shifting unit selected from the group which consists of pneumatic, hydraulic and electric units.

9. The roving machine defined in claim 7, wherein the push/pull device includes a scissor linkage system.

10. The roving machine defined in claim 7 wherein the push/pull device includes a threaded spindle and spindle nut.

11. A roving machine with a device for the automatic replacement of full roving bobbins with empty roving sleeves which are mounted on bobbin carriers arranged in two longitudinal rows on a spindle rail, wherein a respective flyer is rotatable above each bobbin carrier on a respective flyer rail, the device comprising:

a plurality of guide rails extending substantially transversely to a longitudinal dimension of the machine and of the longitudinal rows and each of which is juxtaposible with a respective bobbin carrier of each of the two longitudinal rows; and hangers for movement within said guide rails for suspending full roving bobbins and empty roving sleeves and forming respective suspension carriage trains respectively displaceable in said guide rails into a region of the bobbin rail and a replacement region, the guide rails being movable for bobbin replacement in a horizontal plane below lower edges of the flyers.

12. The roving machine defined in claim 11, wherein the guide rails are located during the changing process in respective vertical planes each of which contains the two bobbin carriers with which the guide rails are respectively juxtaposed.

13. A roving machine with a device for the automatic replacement of full roving bobbins by empty roving sleeves which are mounted on bobbin carriers arranged in two longitudinal rows on a spindle rail, wherein a respective flyer is rotatable above each bobbin carrier on a respective flyer rail, the device comprising:

a plurality of guide rails extending substantially transversely to a longitudinal dimension of the machine and of the longitudinal rows and each of which is juxtaposible with a respective bobbin carrier of each of the two longitudinal rows;

hangers in said guide rails for suspending full roving bobbins and empty roving sleeves and forming respective suspension carriage trains respectively displaceable in said guide rails into a region of the bobbin rail and a replacement region, the guide rails being movable for bobbin replacement in a horizontal plane below lower edges of the flyers, the guide rails upon bobbin replacement, being laterally oriented with respect to vertical planes each of which contains the two bobbin carriers with which the guide rails are respectively juxtaposed, the bobbin rail being laterally shiftable so that the vertical plane containing each two bobbin carriers each coincide with respective vertical planes of the respective guide rail.

14. The roving machine defined in claim 13, wherein the guide rails are swingable about horizontal axes above the bobbin rail.

* * * * *